US011367359B2

(12) United States Patent
Kusumi et al.

(10) Patent No.: US 11,367,359 B2
(45) Date of Patent: Jun. 21, 2022

(54) AIRSPACE MANAGEMENT SYSTEM, AIRSPACE MANAGEMENT METHOD, AND PROGRAM THEREFOR

(71) Applicant: RAKUTEN GROUP, INC., Tokyo (JP)

(72) Inventors: Jin Kusumi, Tokyo (JP); Norihisa Miyake, Tokyo (JP)

(73) Assignee: RAKUTEN GROUP, INC., Tokyo (JP)

( * ) Notice: Subject to any disclaimer, the term of this patent is extended or adjusted under 35 U.S.C. 154(b) by 68 days.

(21) Appl. No.: 16/770,944

(22) PCT Filed: Dec. 27, 2018

(86) PCT No.: PCT/JP2018/048215

§ 371 (c)(1),
(2) Date: Jun. 8, 2020

(87) PCT Pub. No.: WO2020/136822

PCT Pub. Date: Jul. 2, 2020

(65) Prior Publication Data

US 2021/0225176 A1 Jul. 22, 2021

(51) Int. Cl.
*G08G 5/00* (2006.01)

(52) U.S. Cl.
CPC ..... *G08G 5/0026* (2013.01); *G08G 5/0034* (2013.01)

(58) Field of Classification Search
CPC .. G08G 5/0026; G08G 5/0034; G08G 5/0069; G08G 5/0013
See application file for complete search history.

(56) References Cited

U.S. PATENT DOCUMENTS 9,734,723 B1 * 8/2017 Bruno ..... G08G 5/0052
9,792,613 B2 * 10/2017 Gong ..... H04L 67/12
(Continued)

FOREIGN PATENT DOCUMENTS

EP 3347270 * 10/2019
JP 2018081675 A 5/2018
(Continued)

OTHER PUBLICATIONS

"A Concept of Airspace Configuration and Operational Rules for UAS in Current Airspace;" Bizhao Pang, Wei Dai, Thu Ra, Kin Huat Low; 2020 AIAA/IEEE 39th Digital Avionics Systems Conference (DASC) (pp. 1-9); Oct. 11, 2020. (Year: 2020).*
(Continued)

*Primary Examiner* — Khoi H Tran
*Assistant Examiner* — Jorge O Peche
(74) *Attorney, Agent, or Firm* — HEA Law PLLC

(57) ABSTRACT

An airspace is appropriately allocated when the airspace is allocated to an unmanned aerial vehicle. Authority level acquisition means of an airspace management system acquires, for each unmanned aerial vehicle, an authority level of an operation of the unmanned aerial vehicle. Airspace level acquisition means acquires, for each airspace occupying a fixed range, an airspace level indicating an allowable range of the authority level in the airspace. Determination means determines whether or not the unmanned aerial vehicle can fly in a given airspace based on the authority level and the airspace level.

13 Claims, 9 Drawing Sheets

(56) References Cited

U.S. PATENT DOCUMENTS

| | | | | |
|---|---|---|---|---|
| 9,805,372 | B2 * | 10/2017 | Gong | G06F 21/44 |
| 9,805,607 | B2 * | 10/2017 | Gong | G06F 21/44 |
| 9,870,566 | B2 * | 1/2018 | Gong | G06F 16/29 |
| 11,120,456 | B2 * | 9/2021 | Gong | G08G 5/0026 |
| 11,138,893 | B2 * | 10/2021 | Cao | G08G 5/0039 |
| 2015/0228196 | A1 * | 8/2015 | Sampigethaya | B64D 43/00 701/120 |
| 2016/0288905 | A1 * | 10/2016 | Gong | G08G 5/0026 |
| 2016/0292403 | A1 * | 10/2016 | Gong | G08G 5/0078 |
| 2016/0292696 | A1 * | 10/2016 | Gong | G06F 21/44 |
| 2017/0169713 | A1 * | 6/2017 | Gong | G08G 5/0008 |
| 2017/0301220 | A1 * | 10/2017 | Jarrell | G05D 1/0022 |
| 2017/0323572 | A1 * | 11/2017 | Chan | G08G 5/045 |
| 2017/0364065 | A1 * | 12/2017 | Petruzzelli | G08G 5/0069 |
| 2018/0068567 | A1 * | 3/2018 | Gong | G05D 1/106 |
| 2018/0082308 | A1 * | 3/2018 | Gong | H04L 67/12 |
| 2018/0211263 | A1 * | 7/2018 | Gong | G08G 5/0034 |
| 2019/0114925 | A1 * | 4/2019 | Schulman | G06F 21/31 |
| 2020/0126436 | A1 * | 4/2020 | Cao | G08G 5/045 |
| 2020/0334992 | A1 * | 10/2020 | Yamada | B64F 1/36 |
| 2020/0365037 | A1 * | 11/2020 | Yamada | G01C 21/34 |
| 2020/0365039 | A1 * | 11/2020 | Yamada | G08G 5/0034 |
| 2021/0302621 | A1 * | 9/2021 | Brown | G06Q 50/28 |

FOREIGN PATENT DOCUMENTS

| | | | |
|---|---|---|---|
| JP | 2021096579 | * | 6/2021 |
| KR | 1020160074897 A | | 6/2016 |
| WO | WO2018052352 | * | 3/2018 |

OTHER PUBLICATIONS

"Recent Research Progress of Unmanned Aerial Vehicle Regulation Policies and Technologies in Urban Low Altitude;" Chenchen Xu, Xiaohan Liao, Junming Tan, Huping Ye, Haiying Lu; IEEE Access (vol. 8, pp. 74175-74194); Jan. 1, 2020. (Year: 2020).*

"An approach to assess the safety of ADS-B based unmanned aerial systems;" Daniel Baraldi Sesso, Lucio F. Vismari, Joao Batista Camargo; 2014 International Conference on Unmanned Aircraft Systems (ICUAS) (pp. 669-676); May 1, 2014. (Year: 2014).*

English Translation of the International Search Report for PCT/JP2018/048215 dated Apr. 9, 2019.

* cited by examiner

FIG.3

| PROFILE | ITEM | VALUE | SCORE |
|---|---|---|---|
| OPERATION | PURPOSE OF FLIGHT | HOBBY | 10 |
| | | BUSINESS | 20 |
| | | EMERGENCY | 50 |
| | FLIGHT MODE | MANUAL OPERATION | 10 |
| | | AUTONOMOUS FLIGHT | 20 |
| PILOT | LENGTH OF EXPERIENCE | LESS THAN 6 MONTHS | 10 |
| | | 6 MONTHS TO 12 MONTHS | 20 |
| | | 1 YEAR TO 2 YEARS | 50 |
| | | 2 YEARS OR MORE | 80 |
| AIRCRAFT SPECIFICATIONS | MAXIMUM SPEED | LESS THAN 50 km/h | 10 |
| | | 50 km/h OR MORE | 30 |
| | SENSOR ACCURACY | 1 m OR MORE | 10 |
| | | LESS THAN 1 m | 30 |
| ... | ... | ... | ... |

FIG.4

| PROFILE | ITEM | VALUE | SCORE |
|---|---|---|---|
| BUILDING DENSITY LEVEL | – | LESS THAN 5 BUILDINGS | 10 |
| | | 6 BUILDINGS OR MORE | 30 |
| POPULATION DENSITY LEVEL | – | LESS THAN 10 PERSONS /$km^2$ | 10 |
| | | 10 PERSONS/$km^2$ OR MORE | 30 |
| PLANT AND ANIMAL INHABITATION | PLANT | ABSENT | 0 |
| | | PRESENT | 20 |
| | ANIMAL | ABSENT | 0 |
| | | PRESENT | 20 |
| CONGESTION DEGREE | – | 2 VEHICLES OR LESS | 0 |
| | | 3 VEHICLES TO 7 VEHICLES | 20 |
| | | 8 VEHICLES OR MORE | 50 |
| WEATHER | RAINFALL AMOUNT | LESS THAN 1 mm/h | 0 |
| | | 1 mm/h OR MORE | 30 |
| | WIND VELOCITY | LESS THAN 1 m/s | 0 |
| | | 1 m/s OR MORE | 30 |
| ... | ... | ... | ... |

AIRSPACE MANAGEMENT SYSTEM, AIRSPACE MANAGEMENT METHOD, AND PROGRAM THEREFOR

CROSS REFERENCE TO RELATED APPLICATIONS

This application is a National Stage of International Application No. PCT/JP2018/048215 filed on Dec. 27, 2018. The contents of the above document is incorporated herein by reference in its entirety.

TECHNICAL FIELD

The present invention relates to an airspace management system, an airspace management method, and a program therefor.

BACKGROUND ART

Hitherto, there has been known a traffic management system (UAV traffic management (UTM)) configured to perform traffic management of an unmanned aerial vehicle (for example, a drone). The UTM communicates to/from an unmanned aerial vehicle occasionally, and manages a current position and a planned path of the unmanned aerial vehicle and other various kinds of information relating to the unmanned aerial vehicle, while, for example, proposing and determining an appropriate flight path. It is conceivable that the importance of the UTM automatically proposing and determining a flight path increases in the future as unmanned aerial vehicles become more widespread and as the number of flying unmanned aerial vehicles increases.

For example, in Patent Literature 1, there is disclosed a technology for correcting the flight path of an unmanned aerial vehicle based on weather conditions and preventing the unmanned aerial vehicle from having the flight path overlapping with that of another unmanned aerial vehicle when flying in the same section as that of the another unmanned aerial vehicle at a specific time.

CITATION LIST

Patent Literature

[PTL 1] JP 2018-081675 A

SUMMARY OF INVENTION

Technical Problem

However, with the above-mentioned technology, sufficient airspaces cannot be allocated flexibly, which raises a fear that airspaces cannot be utilized efficiently enough and a fear that the flight path cannot be proposed appropriately.

One or more embodiments of the present invention have been made in view of the above-mentioned issues, and are directed to provide an airspace management system, an airspace management method, and a program therefor, which allow an airspace to be allocated to an unmanned aerial vehicle more appropriately.

Solution to Problem

In order to solve the above-mentioned issues, according to one embodiment of the present invention, there is provided an airspace management system including: authority level acquisition means for acquiring, for each unmanned aerial vehicle, an authority level of an operation of the unmanned aerial vehicle; airspace level acquisition means for acquiring, for each airspace occupying a fixed range, an airspace level indicating an allowable range of the authority level in the airspace; and determination means for determining based on the authority level and the airspace level whether the unmanned aerial vehicle is flyable in a given airspace.

Further, in one aspect of the present invention, the authority level is calculated based on a purpose of a flight, a flight mode, a skill of a pilot of the unmanned aerial vehicle, or an aircraft performance of the unmanned aerial vehicle.

Further, in one aspect of the present invention, the airspace level is calculated based on a building density level, a population density level, presence or absence of plant and animal inhabitation, a terrain, a congestion degree in terms of the unmanned aerial vehicle, or weather.

Further, in one aspect of the present invention, the airspace management system further includes flyable airspace information generation means for generating flyable airspace information indicating the airspace in which the unmanned aerial vehicle is flyable.

Further, in one aspect of the present invention, the airspace management system further includes: permit application acquisition means for acquiring a flight permit application including: departure-and-arrival position information indicating a departure position, which is a position where the unmanned aerial vehicle starts flying, and an arrival position, which is a position where the unmanned aerial vehicle finishes flying; and departure-and-arrival time information indicating a departure time, which is a time when the unmanned aerial vehicle starts flying, and an arrival time, which is a time when the unmanned aerial vehicle finishes flying; and flight path generation means for generating a flight path based on the flight permit application, and the determination means is further configured to determine based on the flight permit application whether the flight path connecting the departure position and the arrival position over a period from the departure time to the arrival time is allowed to be generated, and the flight path generation means is configured to generate the flight path when the flight path is allowed to be generated.

Further, in one aspect of the present invention, the determination means is configured to determine again at the departure time whether the flight path is allowed to be generated based on the flight permit application and the flyable airspace information updated at the departure time, when a time at which the flight permit application is acquired is earlier than the departure time by a predetermined amount of time or more, and the flight path generation means is configured to delete, when it is determined that the flight path is not allowed to be generated at the departure time, the flight path generated when the flight permit application is acquired, and generate an alternative flight path different from the flight path.

Further, in one aspect of the present invention, the airspace management system further includes unmanned aerial vehicle control means for controlling the flight of the unmanned aerial vehicle based on the flight path generated by the flight path generation means.

Further, in one aspect of the present invention, the determination means is configured to determine that, for each airspace, the airspace is a flyable airspace when the authority level is higher than the airspace level by a predetermined value or more.

Further, in one aspect of the present invention, the airspace level has a value calculated by performing integration or averaging every unit time during a period from a time when the flight permit application is acquired until the departure time.

Further, in one aspect of the present invention, the airspace management system further includes: permit application acquisition means for acquiring a flight permit application including: departure-and-arrival position information indicating a departure position, which is a position where the unmanned aerial vehicle starts flying, and an arrival position, which is a position where the unmanned aerial vehicle finishes flying; and departure-and-arrival time information indicating a departure time, which is a time when the unmanned aerial vehicle starts flying, and an arrival time, which is a time when the unmanned aerial vehicle finishes flying; and flight path generation means for generating a flight path based on the flight permit application, and setting a width of the flight path allowed for the unmanned aerial vehicle based on the authority level and the airspace level, and the congestion degree is set for each airspace based on a number of overlaps with the flight path having the width.

According to one embodiment of the present invention, there is provided an airspace management method including: an authority level acquisition step of acquiring, for each unmanned aerial vehicle, an authority level of an operation of the unmanned aerial vehicle; an airspace level acquisition step of acquiring, for each airspace occupying a fixed range, an airspace level indicating an allowable range of the authority level in the airspace; and a determination step of determining based on the authority level and the airspace level whether the unmanned aerial vehicle is flyable in a given airspace.

According to one embodiment of the present invention, there is provided a program for causing a computer to function as: authority level acquisition means for acquiring, for each unmanned aerial vehicle, an authority level of an operation of the unmanned aerial vehicle; airspace level acquisition means for acquiring, for each airspace occupying a fixed range, an airspace level indicating an allowable range of the authority level in the airspace; and determination means for determining based on the authority level and the airspace level whether the unmanned aerial vehicle is flyable in a given airspace.

Advantageous Effects of Invention

According to one or more embodiments of the present invention, an airspace can be more appropriately allocated when the airspace is allocated to an unmanned aerial vehicle.

BRIEF DESCRIPTION OF DRAWINGS

FIG. 3 is a table for showing an example of an authority level table.

FIG. 4 is a table for showing an example of an airspace level table.

DESCRIPTION OF EMBODIMENTS

Figure 1:
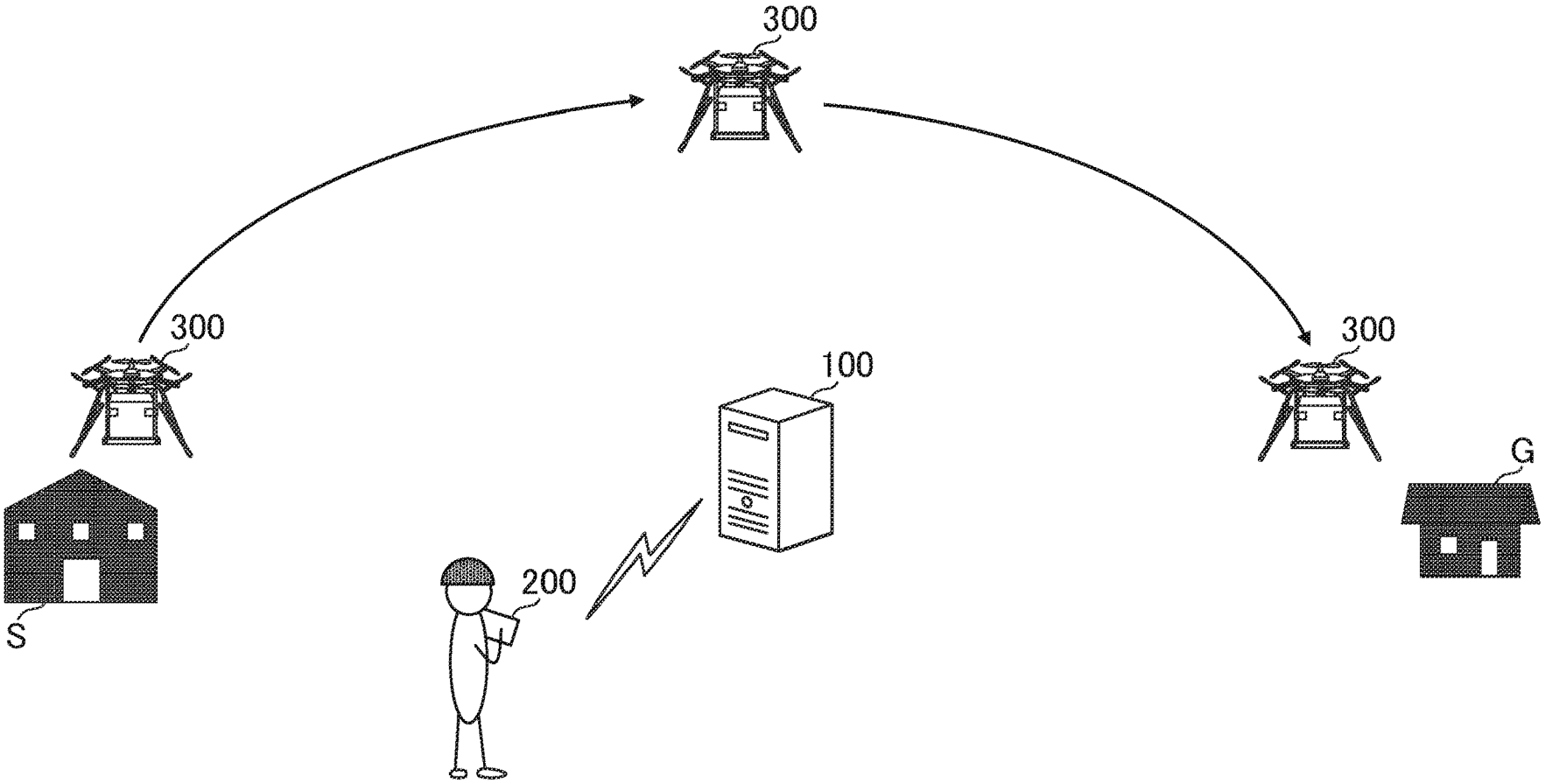
FIG. 1 is a diagram for illustrating a manner in which an unmanned aerial vehicle flies.

Now, a preferred embodiment for implementing the present invention (hereinafter referred to as "the embodiment") is described. First, a description is given of an outline of an overview of a flight of an unmanned aerial vehicle 300 to be achieved by the embodiment of the present invention. FIG. 1 is a diagram for illustrating a manner in which the unmanned aerial vehicle 300 flies in an airspace approved by an airspace management system 10.

As illustrated in FIG. 1, a user possesses a support device 200, for example, a tablet computer. First, the user inputs, to the support device 200, a flight permit application including departure-and-arrival position information indicating a departure position S and an arrival position G and departure-and-arrival time information indicating a departure time and an arrival time. In this case, the departure position S is a position where the unmanned aerial vehicle starts flying, and the arrival position G is a position where the unmanned aerial vehicle finishes flying. The departure time is a time when the unmanned aerial vehicle starts flying, and the arrival time is a time when the unmanned aerial vehicle finishes flying. The flight permit application input to the support device 200 is transmitted to a server 100 through, for example, the Internet or a wireless LAN.

The server 100 is an information processing device configured to provide information and a processing result in response to a flight permit application or another such request acquired from the support device 200. The server 100 creates, based on the flight permit application, a flight path plan that involves passing only through an airspace in which the flight can be approved, and approves the flight permit application. When the departure time included in the flight permit application is reached, the unmanned aerial vehicle 300 flies from the departure position S to the arrival position G by an autonomous flight or by the user's (pilot's) manual operation.

The unmanned aerial vehicle 300 is an airplane with no human being aboard, and examples thereof include a battery-driven unmanned aerial vehicle 300 (so-called drone) or an engine-driven unmanned aerial vehicle 300. For example, the unmanned aerial vehicle 300 may be capable of carrying a package of merchandise, mail, or another such content. For example, the unmanned aerial vehicle 300 flies for the purpose of flying to a delivery destination to deliver a package or flying to a collection destination to collect a package. In addition, as described later, the unmanned aerial vehicle 300 may fly for various purposes, and may fly for purposes of not only carrying a package but also, for example, photographing, detecting meteorological information, security, or spraying pesticides.

The description of the embodiment is directed to a case in which one support device 200 and one unmanned aerial vehicle 300 are included in the airspace management system 10, but the airspace management system 10 may include a plurality of support devices 200 and a plurality of unmanned aerial vehicles 300.

According to the above-mentioned configuration, the airspace management system 10 allows the unmanned aerial vehicle 300 to fly only in an airspace allocated more appropriately. The airspace management system 10 is described below in detail.

Figure 2:
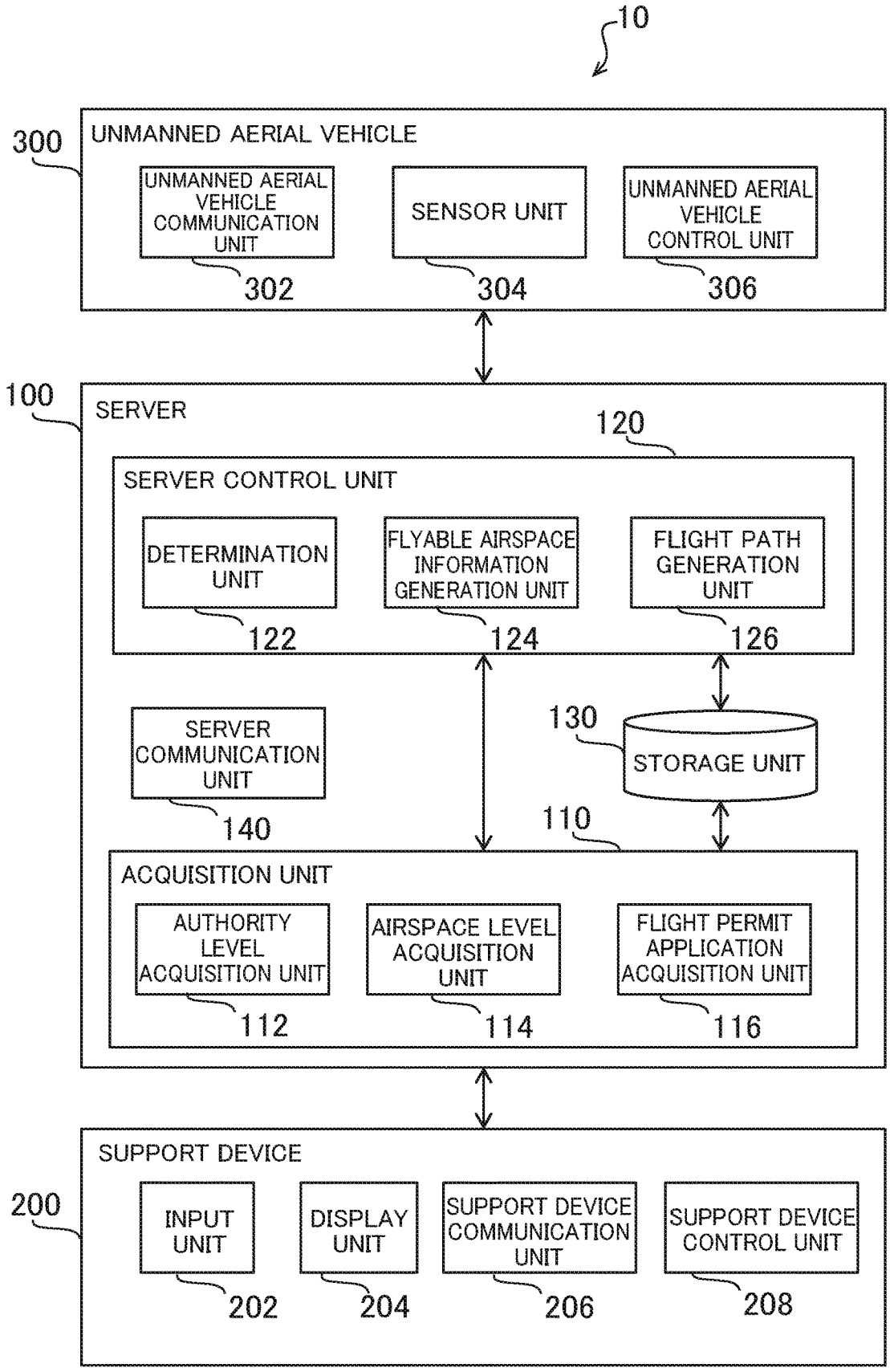
FIG. 2 is a diagram for illustrating an overall configuration of an airspace management system.

FIG. 2 is a block diagram for illustrating a functional configuration of the airspace management system 10. The airspace management system 10 includes the server 100, the support device 200, and an unmanned aerial vehicle 300. The server 100 includes an acquisition unit 110, a server control unit 120, a storage unit 130, and a server communication unit 140. The support device 200 includes an input unit 202, a display unit 204, a support device communication unit 206, and a support device control unit 208. The unmanned aerial vehicle 300 includes an unmanned aerial vehicle communication unit 302, a sensor unit 304, and an unmanned aerial vehicle control unit 306.

The acquisition unit 110 includes an authority level acquisition unit 112, an airspace level acquisition unit 114, and a flight permit application acquisition unit 116. The authority level acquisition unit 112 acquires, for each unmanned aerial vehicle 300, an authority level of an operation of the unmanned aerial vehicle 300. Specifically, the authority level acquisition unit 112 acquires an authority level calculated based on, for example, the purpose of a flight, a flight mode, the skill of a pilot of the unmanned aerial vehicle 300, or the aircraft performance of the unmanned aerial vehicle 300. The authority level is calculated based on an authority level table.

FIG. 3 is a table for showing an example of the authority level table. The authority level table has a profile field, an item field, a value field, and a score field. The profile field and the item field indicate an upper category and a lower category of each item for calculating the authority level. For example, in the profile field, values of an operation relating to a flight, a pilot, and aircraft specifications are set. As specific concepts of the operation relating to the flight, values of the purpose of the flight and the flight mode are set in the item field. As a specific concept of the skill of the pilot of the unmanned aerial vehicle 300, a value of the length of experience of the pilot is set in the item field as well. As specific concepts of the aircraft performance of the unmanned aerial vehicle 300, values of the maximum speed and sensor accuracy of the unmanned aerial vehicle 300 are set in the item field as well.

In the value field, a reference value for evaluating the authority level is set for each item. For example, in association with the purpose of the flight, values of a hobby, a business, and an emergency are set in the value field. The value of the hobby in the item field indicates that the purpose is a hobby or another such purpose of making the user enjoy personally. The value of the business indicates that the purpose is for profit, for example, a purpose of transporting a package. The value of the emergency indicates an urgent purpose, for example, a purpose of an investigation of a victim of an accident/distress or a survey at the time of a disaster.

In association with the flight mode, values of a manual operation and an autonomous flight are set in the value field as well. The value of the manual operation in the item field indicates that the unmanned aerial vehicle 300 flies by being manually operated by the user. The value of the autonomous flight in the item field indicates that the unmanned aerial vehicle 300 automatically flies in accordance with a program stored in advance.

In association with the length of the experience, values of less than 6 months, 6 months to 12 months, 1 year to 2 years, and 2 years or more are set in the value field as well. The values in the item field each indicate the length of the pilot experience of the user who pilots the unmanned aerial vehicle 300.

In association with the maximum speed, values of less than 50 km/h and 50 km/h or more are set in the value field as well. The values in the item field each indicate the specification of the maximum speed of the unmanned aerial vehicle 300.

In association with the sensor accuracy, values of less than 1 m and 1 m or more are set in the value field as well. The values in the item field each indicate the accuracy of a sensor configured to detect the current position of the unmanned aerial vehicle 300. The values in the item field each indicate the specification of the sensor sensitivity.

In the score field, a score for calculating the authority level is set in association with the value field. For example, scores of 10, 20, and 50 are set in the score field in association with the hobby, the business, and the emergency, respectively, in the value field. It is required to provide the operation with more flexibility when the purpose of the flight is a business purpose or an emergency purpose than when the purpose is a hobby purpose. Therefore, the scores of 20 and 50, which are larger than 10 associated with the hobby, are set in the score field associated with the business and the emergency, respectively.

Scores of 10 and 20 are set in the score field as well in association with the manual operation and the autonomous flight, respectively, in the value field. The possibility that the flight can be performed stably (for example, on the scheduled time or along the path) is higher when the autonomous flight is performed than when the flight is performed by the manual operation. Therefore, the score of 20, which is larger than 10 associated with the manual operation, is set in the score field associated with the autonomous flight.

Scores of 10, 20, 50, and 80 are set in the score field as well in association with less than 6 months, 6 months to 12 months, 1 year to 2 years, and 2 years or more, respectively, in the value field. It is general that the piloting skill of the pilot is further improved as the experience of the pilot becomes longer, and hence the possibility that the flight can be performed stably becomes higher as the experience of the pilot becomes longer. Therefore, a larger score is set in the score field associated with the length of the experience as the value set in the associated value field becomes larger.

Scores of 10 and 30 are set in the score field as well in association with less than 50 km/h and 50 km/h or more, respectively, in the value field. In addition, scores of 10 and 30 are set in the score field in association with less than 1 m and 1 m or more, respectively, in the value field. As the aircraft performance becomes higher, the possibility that the flight can be performed stably becomes higher. Therefore, a higher score is set in the score field associated with the aircraft specifications as the value of the aircraft performance set in the associated value field becomes larger.

The authority level table may have, in the item field in association with the pilot, not only the length of the experience but also, for example, the most recent pilot frequency at the time of the flight permit application and the past accident occurrence probability. The accident occurrence probability can be predicted based on the most recent pilot frequency and the past accident occurrence probability, to thereby allow a more appropriate authority level to be calculated.

In addition, the authority level table may have, in the item field in association with the aircraft specifications, not only the maximum speed and the sensor accuracy but also, for example, an aircraft name, the version of software, a weight, the product name of a battery, and the presence or absence of recall. The accident occurrence probability can be predicted based on how new the software and the battery are, to thereby allow a more appropriate authority level to be calculated.

The authority level acquisition unit 112 acquires the authority level by summing up the respective scores associated with the purpose of the flight, the flight mode, the skill of the pilot of the unmanned aerial vehicle 300, and the aircraft performance of the unmanned aerial vehicle 300, which are included in the flight permit application described later. Specifically, for example, it is assumed that a user having a pilot experience of 1 year and 6 months has applied for flying the unmanned aerial vehicle 300 by a manual operation for a hobby purpose. In addition, it is assumed that the aircraft specifications of the unmanned aerial vehicle 300 have a maximum speed of 30 km/h and a sensor accuracy of 3 m. In this case, the authority level acquisition unit 112 sums up the respective scores in the score field associated with the hobby, the manual operation, 1 year to 2 years, less than 50 km/h, and 1 m or more in the value field. That is, the authority level acquisition unit 112 acquires an authority level of 90.

The airspace level acquisition unit 114 acquires, for each airspace occupying a fixed range, an airspace level indicating an allowable range of the authority level in the airspace. In this case, the allowable range of the authority level refers to, for example, a numerical range having a predetermined value as a lower limit (for example, a range indicating 50 or more) or a predetermined rank (for example, between an A rank and a C rank). Specifically, the airspace level is calculated based on, for example, a building density level, a population density level, the presence or absence of plant and animal inhabitation, a terrain, the congestion degree in terms of the unmanned aerial vehicle 300, or weather. The airspace level is calculated based on an airspace level table.

In this case, the airspace is a region occupying a fixed range. Specifically, the airspace is, for example, a region that matches one section when a map region is divided into sections every 10 m in the north-south direction and the east-west direction. The airspace is described later with reference to FIG. 6 and FIG. 7 by giving a specific example thereof.

FIG. 4 is a table for showing an example of the airspace level table. The airspace level table has a profile field, an item field, a value field, and a score field. The profile field and the item field indicate an upper category and a lower category of each item for calculating the airspace level. For example, in the profile field, values of the building density level, the population density level, the plant and animal inhabitation, the congestion degree, and the weather, which relate to an airspace, are set. As specific concepts of the plant and animal inhabitation, values of a plant and an animal are set in the item field. As specific concepts of the weather, values of a rainfall amount and a wind velocity are set in the item field as well. The item field may have a place in which a value is not set.

In the value field, a reference value for evaluating the airspace level is set for each item. For example, in association with the building density level in the profile field, values of less than 5 buildings and 6 buildings or more are set in the value field. Each value in the value field indicates the number of buildings in the relevant airspace.

In association with the population density level of the profile field, values of 10 persons/km$^2$ or more and less than 10 persons/km$^2$ are set in the value field as well. Each value in the value field indicates the number of persons per square kilometer in the relevant airspace.

In association with the plant and the animal in the item field, values of presence and absence are set in the value field as well. The values of the presence and the absence in the value field each indicate the presence or absence of a plant and an animal that may hinder the flight in the relevant airspace.

Figure 5:
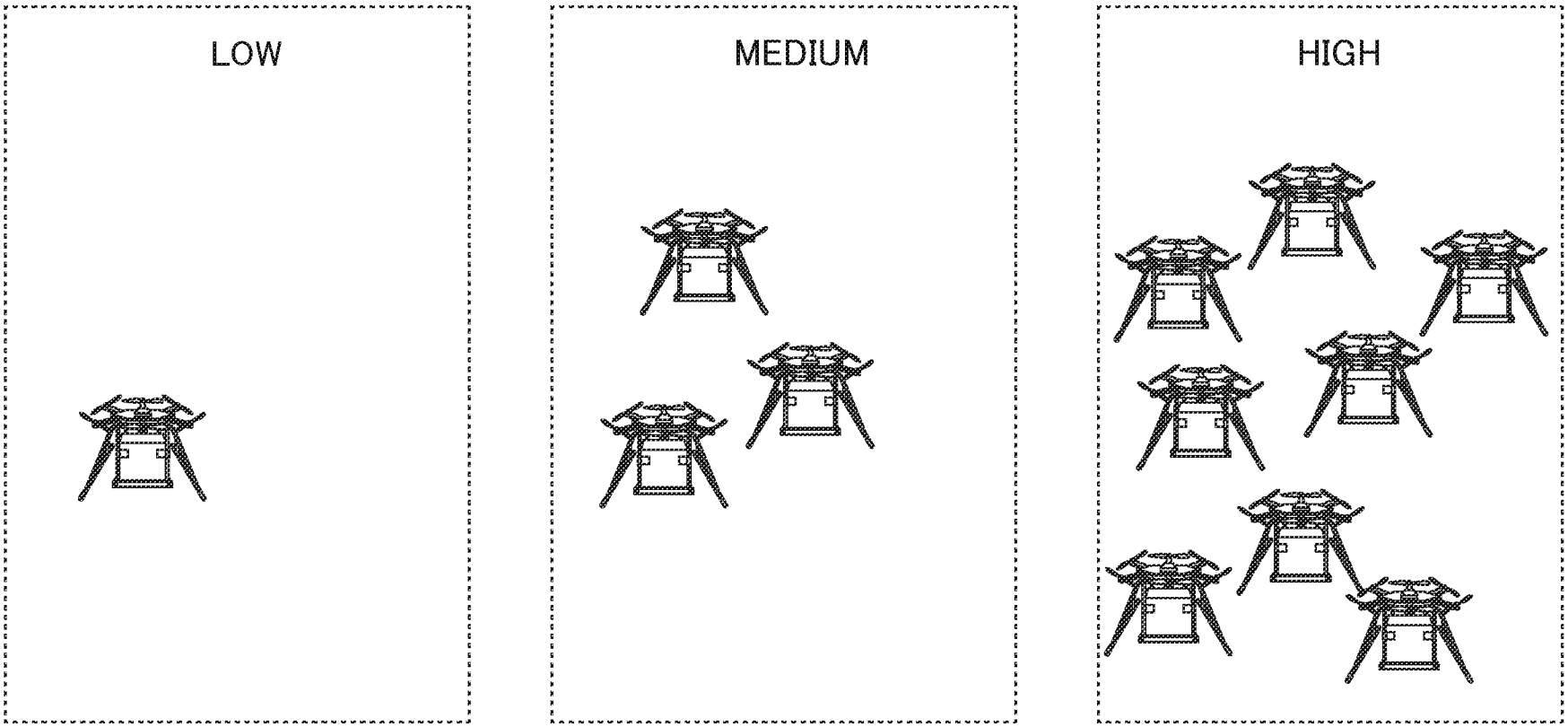
FIG. 5 shows diagrams for each illustrating an example for describing a congestion degree.

In association with the congestion degree in the profile field, values of 2 vehicles or less, 3 vehicles to 7 vehicles, and 8 vehicles or more are set in the value field as well. Each value indicates the congestion degree of the relevant airspace in terms of the unmanned aerial vehicle 300. Specifically, for example, FIG. 5 shows diagrams for each illustrating an unmanned aerial vehicle 300 flying in a region within 100 m north, south, east, and west with the center being the airspace to be evaluated for the congestion degree. The left diagram of FIG. 5 is an illustration of a case in which the congestion degree of the airspace is low under a state in which one unmanned aerial vehicle 300 is flying in one airspace included in the relevant region. In the same manner, the middle diagram of FIG. 5 is an illustration of a case in which the congestion degree of the relevant airspace is medium under a state in which three unmanned aerial vehicles 300 are flying in one airspace included in the relevant region. In the same manner, the right diagram of FIG. 5 is an illustration of a case in which the congestion degree of the relevant airspace is high under a state in which eight unmanned aerial vehicles 300 are flying in one airspace included in the relevant region.

In association with the rainfall amount in the item field, values of less than 1 mm/h and 1 mm/h or more are set in the value field as well. In addition, in association with the wind velocity in the item field, values of less than 1 m/s and 1 m/s or more are set in the value field. Those values indicate the rainfall amount and the wind velocity, respectively, in the relevant airspace.

In the score field, a score for calculating the airspace level is set in association with the value field. For example, scores of 10 and 30 are set in the score field in association with the values of less than 5 buildings and 6 buildings or more, respectively, in the value field. In this case, when a large number of buildings are built in the relevant airspace, it is required to be more cautious in determining whether or not the flight is allowed in the relevant airspace. In view of this, the score of the score field is set so that the score associated with the smaller building density level of less than 5 buildings becomes smaller than the score associated with the larger building density level of 6 buildings or more.

Scores of 10 and 30 are set in the score field as well in association with 10 persons/km$^2$ or more and less than 10 persons/km$^2$, respectively, in the value field. In the same manner as in the case of the building density level, the score in the score field is set so that the score associated with the smaller population density level of less than 10 persons/km$^2$ becomes smaller than the score associated with the larger population density level of 10 persons/km$^2$ or more.

Scores of 0 and 20 are set in the score field as well in association with the absence and the presence, respectively, in the value field. In the same manner as in the above-mentioned case, the score in the score field is set so that the score associated with the absence becomes smaller than the score associated with the presence.

Scores of 0, 20, and 50 are set in the score field as well in association with the values of 2 vehicles or less, 3 vehicles to 7 vehicles, and 8 vehicles or more, respectively, in the value field. In this case, when a large number of unmanned aerial vehicles 300 are flying in the relevant airspace, it is required to be more cautious in determining whether or not the flight is allowed in the relevant airspace. In view of this, the score in the score field is set to a higher score as the associated congestion degree becomes higher.

Scores of 0 and 30 are set in the score field as well in association with the values of less than 1 mm/h and 1 mm/h or more, respectively, in the value field. In addition, scores of 0 and 30 are set in the score field in association with the values of less than 1 m/s and 1 m/s or more, respectively, in the value field. In this case, it is required to be more cautious in determining whether or not the flight is allowed in the relevant airspace as the weather becomes more unsettled in the relevant airspace. In view of this, the score in the score field is set to a higher score as the rainfall amount becomes larger and as the wind velocity becomes higher.

The airspace level acquisition unit 114 acquires the airspace level by summing up the scores associated with all the items for each airspace. Specifically, it is assumed that, in the target airspace, 3 buildings are built, the population density level is 5 persons, no plant or no animal inhabits, the congestion degree is 5 vehicles, the rainfall amount is 0 mm/h, and the wind velocity is 0 m/s. In this case, the airspace level acquisition unit 114 sums up the scores associated with less than 5 buildings, the population density level of less than 10 persons/km$^2$, the absent of a plant and an animal, the congestion degree of 3 vehicles to 7 vehicles, the rainfall amount of less than 1 mm/h, and the wind velocity of less than 1 m/s in the value field. That is, the airspace level acquisition unit 114 acquires an airspace level of 40.

The airspace level may have a value calculated by performing integration or averaging every unit time during a period from a time at which the flight permit application is acquired until the departure time. Specifically, for example, the actual population density level, congestion degree, and weather in each airspace change depending on the time. Therefore, the airspace level may have a value calculated by integrating or averaging the scores obtained for each airspace every hour during a period from the time at which the flight permit application is acquired until the departure time.

The case in which the authority level and the airspace level are represented by numerical values has been described above, but the authority level and the airspace level may be represented by, for example, alphabet letters as long as the authority level and the airspace level can be compared to each other.

As described above, by taking the building density level into consideration as a factor for calculating the airspace level, it is possible to reduce the possibility that an accident may occur due to, for example, radio wave interference or radio wave interruption. In addition, by taking the population density level into consideration, it is possible to reduce human damage in an event of a crash. In addition, by taking the presence or absence of a plant into consideration, it is possible not only to prevent a collision with a tree but also to easily collect the unmanned aerial vehicle 300 in the event of a crash. In addition, by taking the presence or absence of an animal into consideration, it is possible to reduce a risk of a collision with a flying bird. In addition, by taking the congestion degree into consideration, it is possible to avoid contact between the unmanned aerial vehicles 300. In addition, by taking the weather into consideration, it is possible to avoid a crash due to a torrential rain or another such sudden weather change.

The airspace level table may also include, in the profile field and the item field, a terrain elevation difference, the presence or absence of a residential area, an agricultural land, an industrial area, and a government-related facility, the presence or absence of a power facility, and other such ground characteristics. By taking the terrain into consideration, it is possible to avoid a collision with a cliff or a bridge. In addition, by taking the ground characteristics into consideration, it is possible to set the airspace level in consideration of the magnitude of damage in the event of a crash.

The flight permit application acquisition unit 116 acquires a flight permit application including: the departure-and-arrival position information indicating the departure position S, which is the position where the unmanned aerial vehicle 300 starts flying, and the arrival position G, which is the position where the unmanned aerial vehicle 300 finishes flying; and the departure-and-arrival time information indicating the departure time, which is the time when the unmanned aerial vehicle 300 starts flying, and the arrival time, which is the time when the unmanned aerial vehicle 300 finishes flying. Specifically, for example, the user inputs, to the support device 200, the departure-and-arrival position information indicating the departure position S and the arrival position G and the departure-and-arrival time information indicating the departure time and the arrival time. In addition, the user inputs, to the support device 200, the purpose of the flight, the flight mode, the length of the experience, the maximum speed, the accuracy of a sensor, and other such information required for calculating the authority level. With this configuration, the support device 200 generates a flight permit application including information required for calculating the authority level and information for generating a flight path. The flight permit application acquisition unit 116 acquires the flight permit application from the support device 200 through a wireless LAN, the Internet, or another such communication network. The flight permit application may include information relating to the flight path desired by the user.

The server control unit 120 includes, for example, at least one microprocessor. The server control unit 120 executes processing based on a program and data stored in the storage unit 130. Specifically, the server control unit 120 includes a determination unit 122, a flyable airspace information generation unit 124, and a flight path generation unit 126.

The determination unit 122 determines based on the authority level and the airspace level whether or not the unmanned aerial vehicle 300 can fly in a given airspace. Specifically, for example, the determination unit 122 compares, in a given airspace, the airspace level of the given airspace to the magnitude of the authority level, and determines that the given airspace is flyable when the authority level is higher. Ina case where the airspace level and the authority level are represented by alphabet letters, the determination unit 122 may determine whether or not the unmanned aerial vehicle 300 can fly in a given airspace based on the authority level and the airspace level in alphabetical order.

For example, in the case where the authority level and the airspace level are represented by alphabet letters, when an alphabet letter representing the rank of the authority level is alphabetically earlier than an alphabet letter representing the rank of the airspace level, the determination unit 122 may determine that the unmanned aerial vehicle 300 can fly in the relevant airspace. Specifically, when the authority level is the C rank, the determination unit 122 may determine that the unmanned aerial vehicle 300 can fly in the airspaces of a D rank and an E rank.

Figure 6:
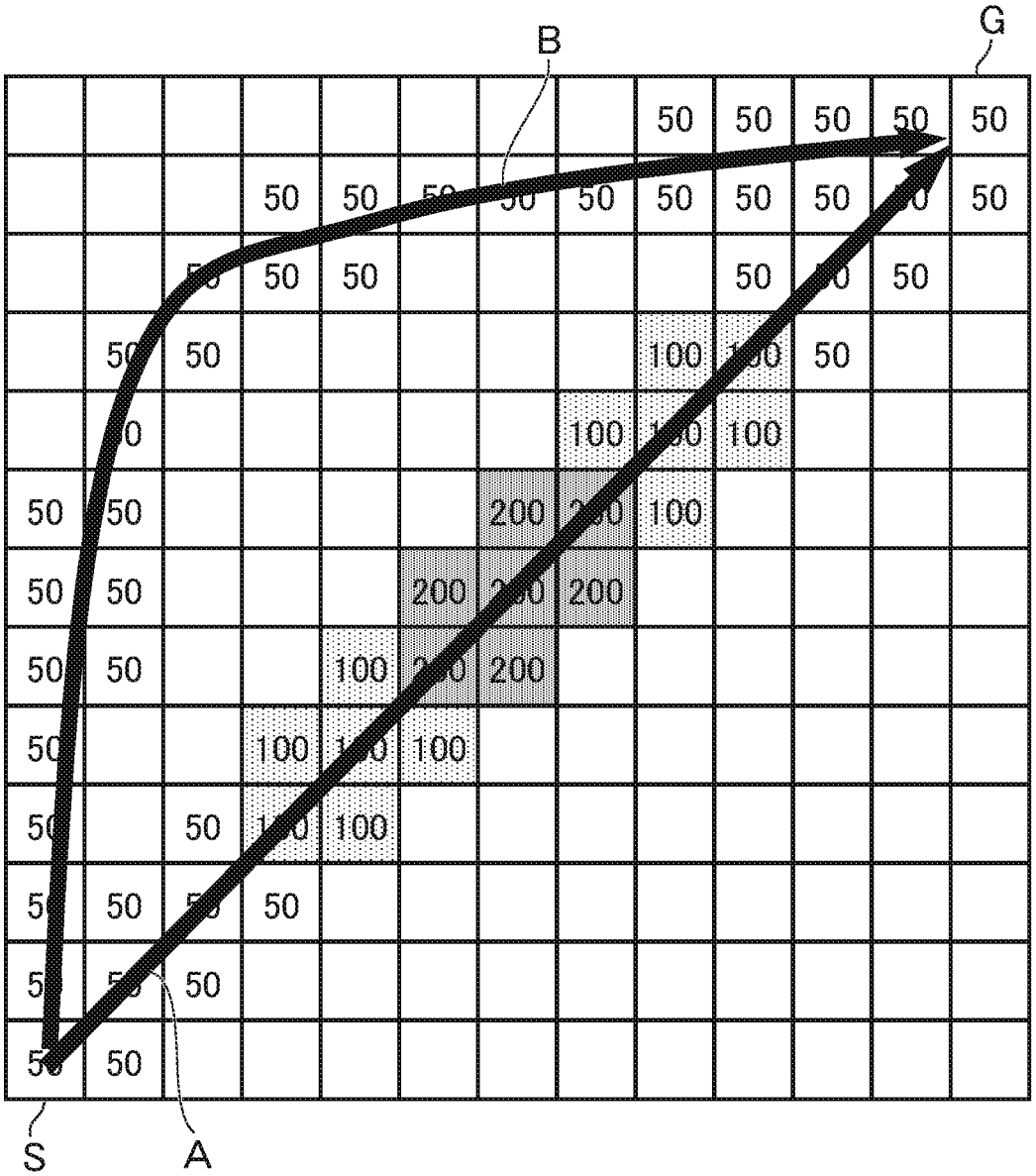
FIG. 6 is a diagram for illustrating a result of determining an airspace on a flight path.

As a specific example, a description is given of a case in which the flight permit application acquisition unit 116 has acquired a flight permit application for flying from the departure position S to the arrival position G as illustrated in FIG. 6. It is also assumed that the flight permit application includes information indicating that the flight is to pass through a path A or a path B and the authority level is 120. Each of rectangles arranged in a matrix as illustrated in FIG. 6 represents an airspace. The numerical value given in each airspace refers to the airspace level of the relevant airspace. In this case, the determination unit 122 compares the authority level to the airspace levels of all airspaces included in the path A and the path B. In this case, the path A is the shortest path that connects the departure position S and the arrival position G. The path B is a detour. Then, as illustrated in FIG. 6, the determination unit 122 determines that, in the airspaces overlapping with the path A and the path B, the unmanned aerial vehicle 300 can fly in the airspaces having airspace levels of 50 and 100, and cannot fly in the airspaces having an airspace level of 200. The path A and the path B may be generated by the flight path generation unit 126, or may be included in the flight permit application acquired by the flight permit application acquisition unit 116.

In another case, the determination unit 122 may determine that, for each airspace, the relevant airspace is a flyable airspace when the authority level is higher than the airspace level by a predetermined value or more. Specifically, for example, when the authority level is higher than the airspace level by 30 or more, the determination unit 122 may determine that the airspace is a flyable airspace. In the above-mentioned example, the determination unit 122 determines that the unmanned aerial vehicle 300 can fly in the airspaces having the airspace level of 50, and cannot fly in the airspaces having the airspace levels of 100 and 200. With this configuration, the flight path generation unit 126 can generate a flight path having a low possibility that the flight permit application may be rejected when the determination is performed again at the departure time as described later.

Figure 7:
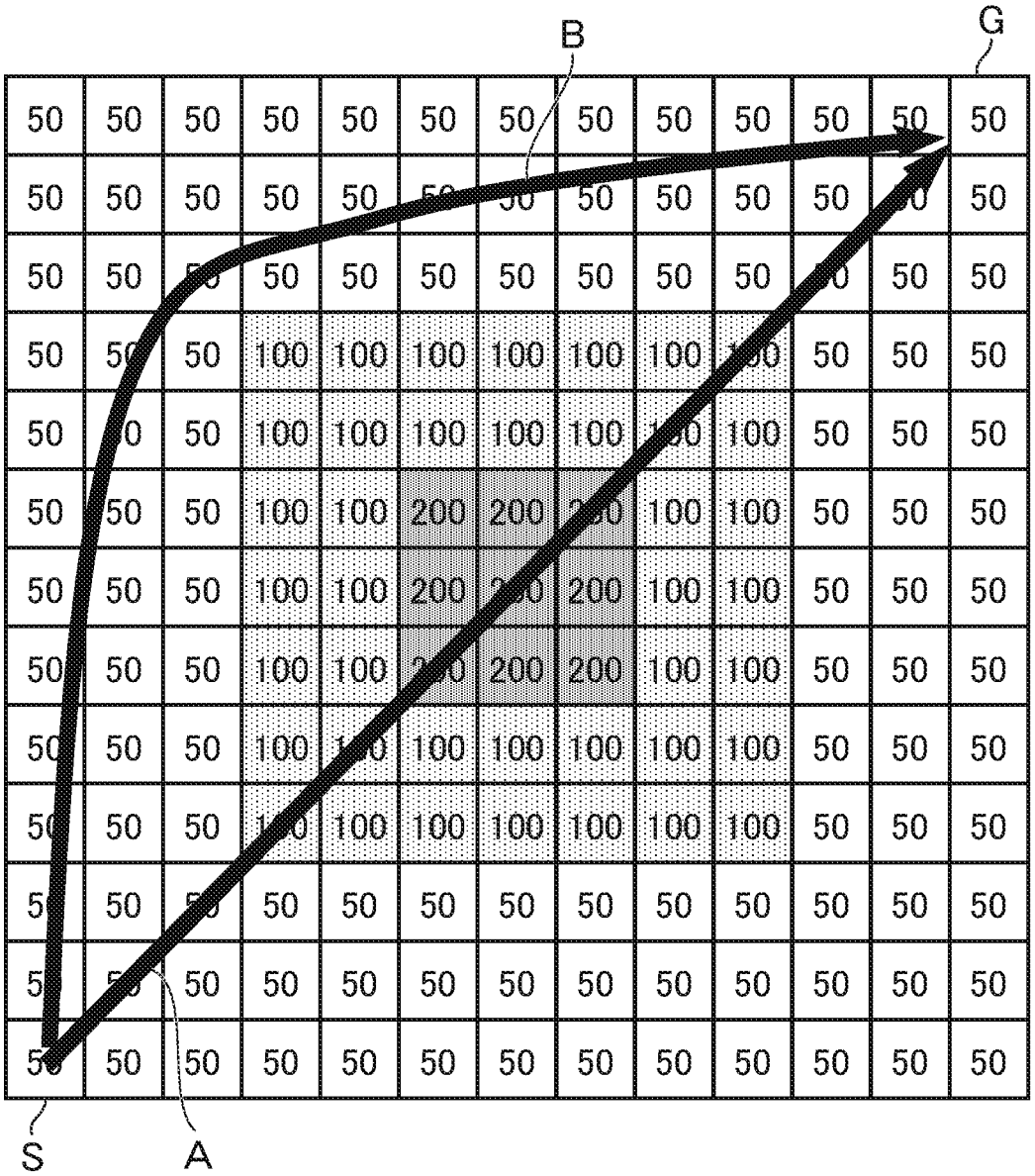
FIG. 7 is a diagram for illustrating an example of flyable airspace information.

The determination unit 122 may further determine whether or not the flight path connecting the departure position S and the arrival position G over a period from the departure time to the arrival time can be generated based on the flight permit application. A specific example thereof is described through use of an example of flyable airspace information illustrated in FIG. 7. FIG. 7 is a diagram for illustrating the airspace level of each of airspaces included in a predetermined region, and the airspaces including the departure position S and the arrival position G are arranged diagonally.

The determination unit 122 determines whether or not it is possible to generate such a path that the airspace levels of all the airspaces included in the path connecting the departure position S and the arrival position G have values smaller than that of the authority level. For example, the path A is the shortest path that connects the departure position S and the arrival position G. In this case, when the authority level is 120, the path A passes through the airspaces having the airspace level of 200, and hence the unmanned aerial vehicle 300 is not allowed to fly on the path A. Meanwhile, the airspace levels of all airspaces included in the path B being a detour are all 50, which is lower than the authority level. Therefore, the unmanned aerial vehicle 300 is allowed to fly on the path B, and hence the determination unit 122 determines that the flight path connecting the departure position S and the arrival position G over the period from the departure time to the arrival time can be generated based on the flight permit application.

In another case, when a time at which the flight permit application is acquired is earlier than the departure time by a predetermined time or more, the determination unit 122 may determine again at the departure time whether or not the flight path can be generated based on the flight permit application and the flyable airspace information updated at the departure time. Specifically, for example, the actual population density level, congestion degree, and weather in each airspace change depending on the time. Therefore, when the time at which the flight permit application is acquired is earlier than the departure time by the predetermined time or more, the airspace level at the time when the flight permit application is acquired may be different from the airspace level at the departure time. Therefore, in this case, the determination unit 122 may determine again at the departure time whether or not the flight path can be generated based on the flyable airspace information updated at the departure time.

The flyable airspace information generation unit 124 generates flyable airspace information indicating an airspace in which each unmanned aerial vehicle 300 can fly. Specifically, for example, the flyable airspace information generation unit 124 generates flyable airspace information indicating the airspace level of each of airspaces included in a predetermined region as illustrated in FIG. 7.

The flight path generation unit 126 generates a flight path based on the flight permit application when the flight path can be generated. Specifically, for example, it is assumed that the flight permit application acquisition unit 116 has acquired a flight permit application that includes the departure-and-arrival position information but no information relating to the flight path. In this case, the flight path generation unit 126 generates one or a plurality of flight path candidates connecting the departure position S and the arrival position G that are included in the flight permit application. For example, the flight path generation unit 126 generates the path A being the shortest path and the path B being a detour. Further, as described above, the determination unit 122 determines whether or not the unmanned aerial vehicle 300 can fly on the path A and the path B, and when it is determined that the path B is flyable, the flight path generation unit 126 generates the path B as a flyable flight path.

In addition, when it is determined that the flight path cannot be generated at the departure time, the flight path generation unit 126 may delete the flight path generated when the flight permit application is acquired, and generate an alternative flight path different from the flight path. Specifically, for example, it is assumed that the flight path generation unit 126 has generated the path B at the time of the flight permit application as described above. In this case, at the departure time, when the airspace level of some of airspaces included in the path B exceeds the authority level due to a change in weather, the flight path generation unit 126 deletes the path B. In addition, the flight path generation unit 126 generates another path candidate, and the determination unit 122 determines whether or not all the airspaces included in the another path candidate are flyable. When there is a flyable path, the flight path generation unit 126 generates the relevant path as an alternative flight path.

The storage unit 130 includes a main memory unit and an auxiliary memory unit. For example, the main memory unit is a volatile memory, for example, a RAM, and the auxiliary memory unit is a non-volatile memory such as a hard disk drive or a flash memory. The storage unit 130 also stores the authority level table and the airspace level table, which are described above.

The server communication unit 140 includes a communication interface for wired communication or wireless communication. The server communication unit 140 performs communication under a predetermined communication protocol. The server communication unit 140 communicates to/from the support device communication unit 206 to transmit and receive, for example, a flight path and selection information (described later). The server communication unit 140 communicates to/from the unmanned aerial vehicle communication unit 302 to transmit and receive a flight path and position information.

The input unit 202 is a user interface configured to receive the user's input. Specifically, examples of the input unit 202 include a touch panel, a keyboard, and a mouse, and the input unit 202 receives the user's operation. The user operates the input unit 202 to input the departure-and-arrival position information, the departure-and-arrival time information, and a desired flight path. When the flight path generation unit 126 generates a plurality of flight path candidates, the input unit 202 may generate selection information indicating which flight path among the candidates is to be selected by the user's operation.

The display unit 204 displays an image under the control of the support device control unit 208. Specifically, examples of the display unit 204 include a liquid crystal display device and an organic EL display device. The display unit 204 displays, for example, an image for receiving a flight permit application under the control of the support device control unit 208.

The support device communication unit 206 includes a communication interface for wired communication or wireless communication. Specifically, the support device communication unit 206 transmits and receives the flight permit application generated by the support device control unit 208 and information relating to rejection to/from the server communication unit 140.

The support device control unit 208 includes, for example, at least one microprocessor. The support device control unit 208 executes processing based on a program or data stored in a storage unit (not shown) included in the support device 200. With this configuration, the support device control unit 208 generates a flight permit application when the user performs input to the input unit 202.

The unmanned aerial vehicle communication unit 302 includes a communication interface for wired communication or wireless communication in the same manner as in the case of the server communication unit 140. The unmanned aerial vehicle communication unit 302 communicates to/from the server communication unit 140 to transmit and receive, for example, a flight path and position information to/from the server communication unit 140.

The sensor unit 304 detects the current position of the unmanned aerial vehicle 300. Specifically, for example, the sensor unit 304 is a global positioning system (GPS) sensor configured to measure the current position of the unmanned aerial vehicle 300 on the earth.

The unmanned aerial vehicle control unit 306 includes, for example, at least one microprocessor. The unmanned aerial vehicle control unit 306 controls the flight of the unmanned aerial vehicle 300 based on the flight path generated by the flight path generation unit 126. That is, the unmanned aerial vehicle control unit 306 controls the flight from the departure position S to the arrival position G over the period from the departure time to the arrival time based on the flight path received by the unmanned aerial vehicle communication unit 302. The flight control performed by the unmanned aerial vehicle control unit 306 may be performed by the server control unit 120 instead.

Figure 8:
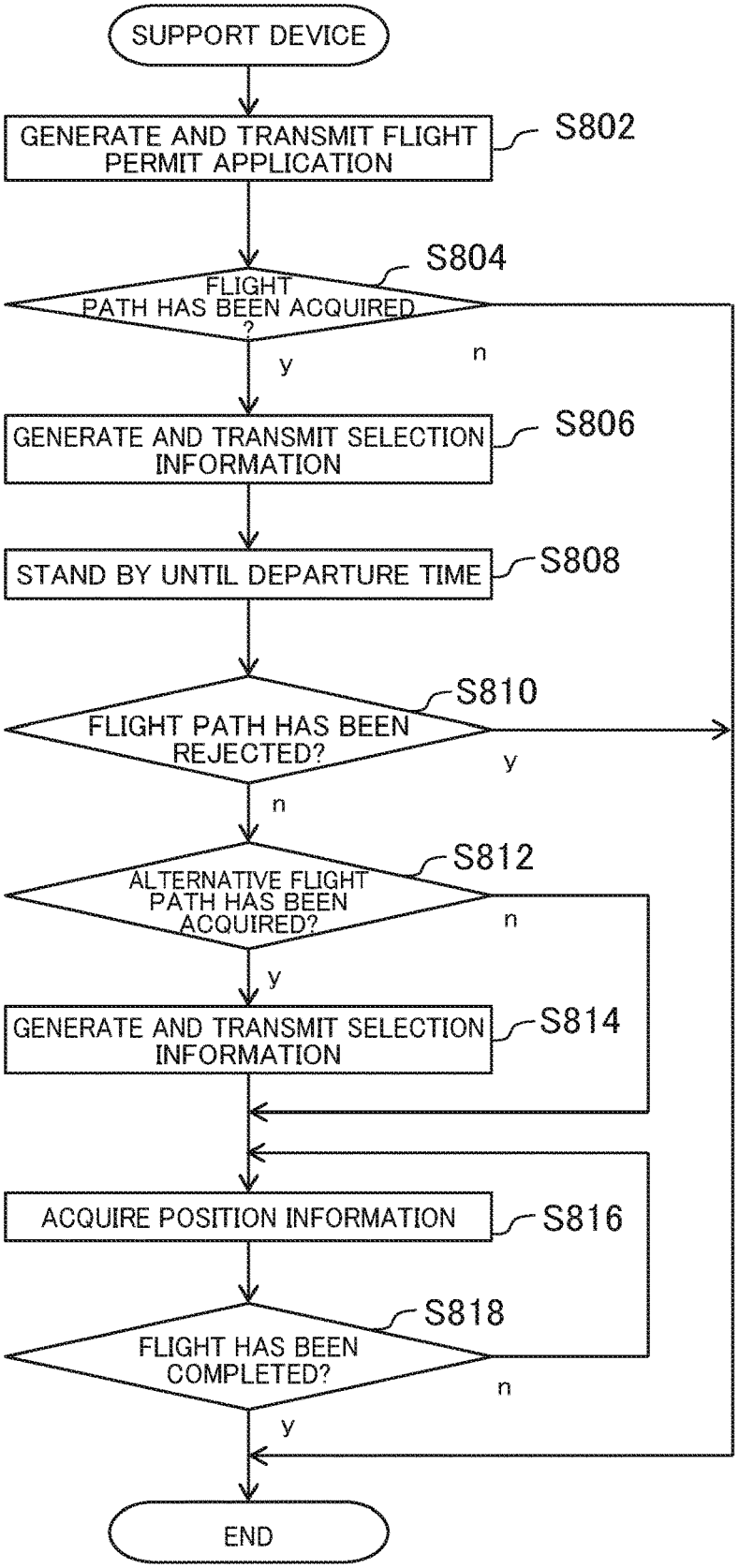
FIG. 8 is a flow chart for illustrating an example of processing to be executed on a server.

Next, a description is given of processing to be executed in the airspace management system 10. FIG. 8 is a flow chart for illustrating an example of processing to be executed on the support device 200. The following processing is an example of processing to be implemented by the functional blocks illustrated in FIG. 2.

First, as illustrated in FIG. 8, the support device 200 acquires a flight permit application, and transmits the flight permit application to the server 100 (Step S802). Specifically, when the user operates the input unit 202, the support device 200 generates a flight permit application including the information required for calculating the authority level and the information for generating a flight path. The support device 200 further transmits the generated flight permit application to the server 100. In this case, it is assumed that the flight permit application does not include information relating to a flight path desired by the user. It is also assumed that a time (application time) at which the flight permit application was transmitted is a time being three hours earlier than the departure time included in the flight permit application.

Subsequently, the support device 200 is in a waiting state, and after the server 100 generates a flight path, acquires the flight path (Step S804). Specifically, when there is a flight path that can be generated based on the flight permit application generated in Step S802, the support device 200 acquires the flight path from the server 100. Meanwhile, when there is no flight path that can be generated by the server 100 (see Step S906), the display unit 204 displays that the flight permit application has been rejected, and brings the processing to an end. In this case, for example, the support device 200 acquires two flight paths including the path A and the path B.

When the support device 200 has acquired the flight path in Step S804, the support device 200 acquires the selection information, and transmits the selection information to the server 100 (Step S806). Specifically, for example, the support device 200 has acquired two flight paths in Step S804, and hence the user selects the path B by operating the input unit 202. With this configuration, the support device 200 generates selection information indicating that the path B is to be selected, and transmits the selection information to the server 100. Even when the number of flight paths acquired by the support device 200 is one, the user inputs, to the input unit 202, the user's consent to the flight path. Then, the support device 200 generates information indicating that the relevant path has been consented to, and transmits the information to the server 100.

Subsequently, the support device 200 stands by until the departure time (Step S808). When the server 100 rejects the flight permit application at the departure time (see Step S926), the support device 200 displays, on the display unit 204, that the flight permit application has been rejected, and brings the processing to an end. Meanwhile, when the server 100 does not reject the flight permit application at the departure time, the processing advances to Step S812 (Step S810).

Subsequently, when the flight permit application is not rejected in Step S810, the support device 200 advances to Step S814 after acquiring the alternative flight path from the server 100, or advances to Step S816 with no alternative flight path being acquired (Step S812). Specifically, when the authority level exceeds the airspace level in all the airspaces included in the path B selected in Step S806, the support device 200 advances to Step S816 without acquiring an alternative flight path. Meanwhile, when, in some of the airspaces included in the path B selected in Step S806, the authority level falls below the airspace level and the server 100 generates an alternative flight path, the server 100 acquires the alternative flight path. In this case, for example, the support device 200 acquires two alternative flight paths including a path C and a path D.

When the support device 200 acquires the alternative flight path from the server 100 in Step S812, the support device 200 acquires the selection information, and transmits the selection information to the server 100 (Step S814). Specifically, for example, the support device 200 has acquired the two flight paths in Step S812, and hence the user selects the path D by operating the input unit 202. With this configuration, the support device 200 generates selection information indicating that the path D is to be selected, and transmits the selection information to the server 100.

The respective steps from Step S810 to Step S814 are performed immediately after the departure time. Therefore, after those steps, the unmanned aerial vehicle 300 starts flying based on the flight path or the alternative flight path selected in Step S806 or Step S814.

Subsequently, the support device 200 repeatedly acquires the position information until the unmanned aerial vehicle 300 completes the flight (Step S816 and Step S818). Specifically, the unmanned aerial vehicle 300 has started flying after Step S812 or Step S814, and hence the unmanned aerial vehicle 300 is present at a different position with a lapse of time. Therefore, the support device 200 acquires the position information indicating the position of the unmanned aerial vehicle 300 from the server 100 at regular time intervals, and displays the position of the unmanned aerial vehicle 300 on the display unit 204. This allows the user to grasp the current position of the unmanned aerial vehicle 300. When the flight of the unmanned aerial vehicle 300 is completed, the support device 200 brings the processing to an end.

Figure 9:
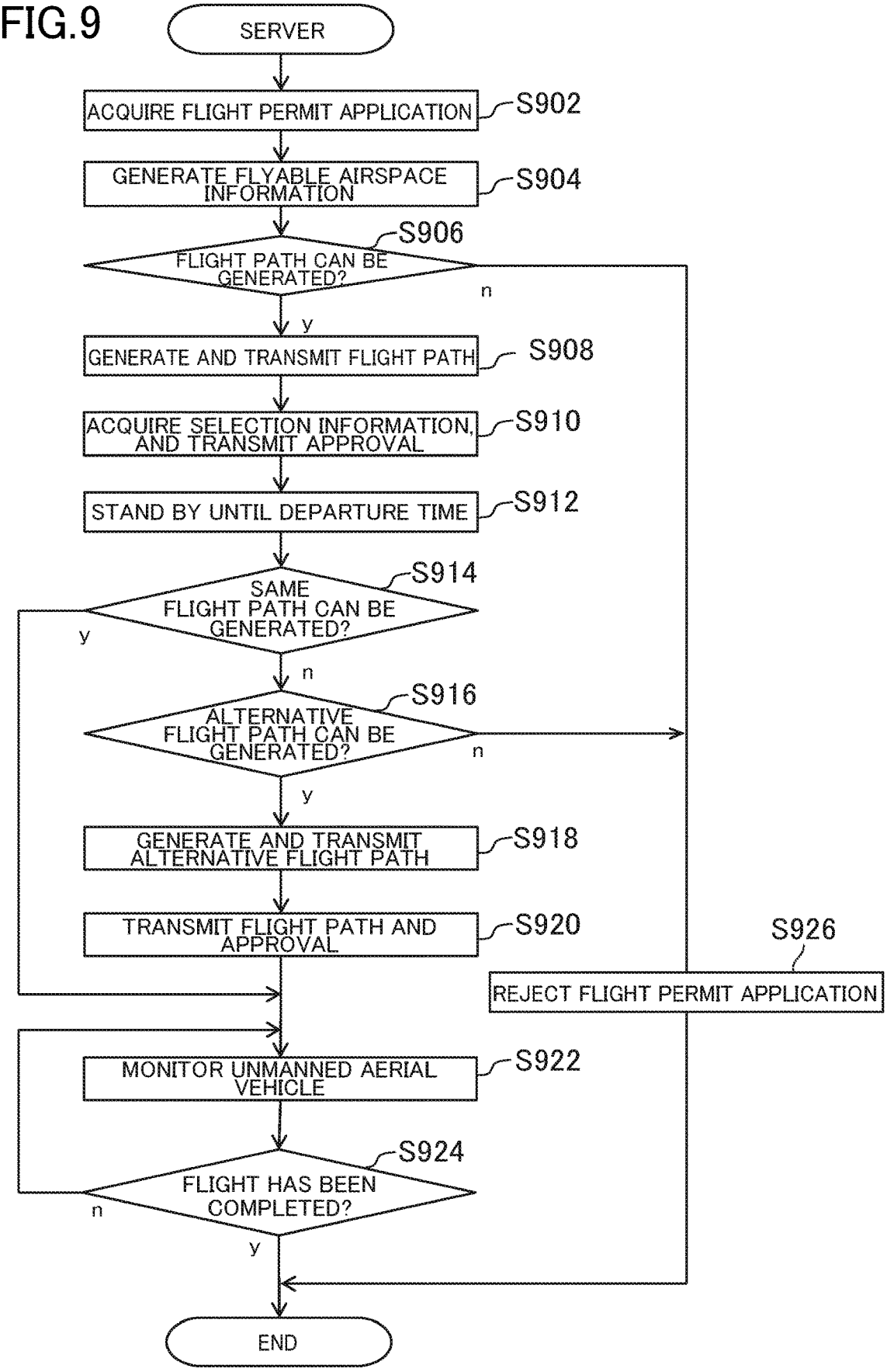
FIG. 9 is a flow chart for illustrating an example of processing to be executed on a support device.

FIG. 9 is a flow chart for illustrating an example of processing to be executed on the server 100. The processing illustrated in FIG. 9 is executed by the server control unit 120 operating in accordance with the program stored in the storage unit 130.

First, the server 100 acquires a flight permit application (Step S902). Specifically, the server 100 acquires a flight permit application generated by the support device 200 in Step S802.

Subsequently, the server 100 generates flyable airspace information (Step S904). Specifically, the server 100 generates flyable airspace information for a predetermined region including the departure position S and the arrival position G based on the departure-and-arrival position information included in the flight permit application acquired in Step S902. The flyable airspace information is also desired to be a value obtained by integrating or averaging the scores obtained for the airspace every unit time during the period from the time when the flight permit application is acquired until the departure time based on the departure-and-arrival time information included in the flight permit application.

Subsequently, in Step S906, when a flight path can be generated based on the flight permit application acquired in Step S902 and the flyable airspace information generated in Step S904, the server 100 generates a flight path, and transmits the flight path to the support device 200 (Step S908). Meanwhile, when the flight path cannot be generated, the server 100 rejects the flight permit application (Step S926). Specifically, when possible, the server 100 generates the path A and the path B based on the flight permit application acquired in Step S902 and the flyable airspace information generated in Step S904, and transmits the path A and the path B to the support device 200.

Meanwhile, when the flight path cannot be generated, the server 100 transmits, to the support device 200, a notification that the flight permit application has been rejected. After transmitting the notification of the rejection, the server 100 brings the processing to an end. This case corresponds to the case in which the support device 200 has not acquired the flight path in Step S804.

Subsequently, the server 100 acquires the selection information, and transmits, to the support device 200, a notification that the flight permit application has been approved (Step S910). Specifically, for example, the server 100 acquires selection information indicating that the path B transmitted from the support device 200 in Step S806 is to be selected, and transmits, to the support device 200, information indicating that the flight of the unmanned aerial vehicle 300 has been approved for the path B. The server 100 also transmits a program for instructing to fly along the path B to the unmanned aerial vehicle 300.

Subsequently, the server 100 stands by until the departure time (Step S912). Then, the server 100 determines again at the departure time whether or not a flight path can be generated based on the flight permit application acquired in Step S902 and the flyable airspace information updated at the departure time (Step S914). When the same flight path can be generated, the processing advances to Step S922, and when the same flight path cannot be generated, the processing advances to Step S916. Specifically, the airspace level of the airspace included in the path B may have changed due to the lapse of time from the time of Step S904 until the time of Step S912. In view of this, the server 100 generates, again at the departure time, flyable airspace information for the same region as that of the flyable airspace information generated in Step S904. Then, the server 100 determines whether or not the path B is a flight path that can be generated.

When it is determined in Step S914 that the same flight path cannot be generated, the server 100 deletes the flight path generated when the flight permit application was acquired, and determines whether or not an alternative flight path different from the flight path can be generated (Step S916). Then, when such an alternative flight path can be generated, the server 100 generates an alternative flight path, and transmits the alternative flight path to the support device 200 (Step S918). Specifically, when the path B cannot be generated at the time of Step S916, the server 100 deletes the once generated path B. When the path C and the path D, which are different from the path B, can be generated, the server 100 generates the path C and the path D, and transmits the path C and the path D to the support device 200. Meanwhile, when the path C and the path D cannot be generated, the processing advances to Step S926, and the server 100 rejects the flight permit application. That is, the server 100 transmits, to the support device 200, a notification that the approval given in Step S910 has been canceled.

Subsequently, the server 100 acquires the selection information, and transmits, to the support device 200, the notification that the flight permit application has been approved (Step S920). Specifically, for example, the server 100 acquires selection information indicating that the path D transmitted from the support device 200 in Step S814 is to be selected, and transmits, to the support device 200, information indicating that the flight of the unmanned aerial vehicle 300 has been approved for the path D. The server 100 also transmits a program for instructing to fly along the path D to the unmanned aerial vehicle 300.

The respective steps from Step S914 to Step S920 are performed immediately after the departure time. Therefore, after those steps, the unmanned aerial vehicle 300 starts flying based on the flight path or the alternative flight path approved in Step S910 or Step S920. In this case, the unmanned aerial vehicle 300 autonomously flies along the path B or the path D.

Subsequently, the server 100 monitors the unmanned aerial vehicle 300 until the unmanned aerial vehicle 300 completes the flight (Step S922 and Step S924). Specifically, the unmanned aerial vehicle 300 has started flying after Step S914 or Step S920, and hence the unmanned aerial vehicle 300 is present at a different position with a lapse of time. Therefore, the server 100 acquires the position information indicating the position of the unmanned aerial vehicle 300 from the unmanned aerial vehicle 300 at regular time intervals, and transmits the position information to the support device 200. This allows the user to grasp the current position of the unmanned aerial vehicle 300. When the flight of the unmanned aerial vehicle 300 is completed, the processing of the server 100 brings the processing to an end.

As described above, according to the embodiment, qualitative events of fairness and appropriateness are handled quantitatively. That is, for example, the performance including an obstacle avoidance function of the flying unmanned aerial vehicle 300, the urgency of the flight purpose, and the social importance of the flight purpose are first quantified based on certain standards. Next, the appropriateness levels of the flight in the airspace determined based on the weather, the population density level, the congestion degree, and other such factors are quantified based on certain standards. The quantification is performed by, for example, digitization or ranking. Then, two quantified numerical values or ranks are compared to each other, and operation management is performed in such a manner that a flight is permitted only when a predetermined relationship is satisfied.

Through the above-mentioned three-step procedure, consideration is given to information including the aircraft performance of the unmanned aerial vehicle 300 and the experience of the pilot, which has not been taken into consideration in the related-art traffic management technology. For example, even when the aircraft performance of the unmanned aerial vehicle 300 is low or the experience of the pilot is poor, an appropriate flight path is set based on the aircraft performance or the experience so as to avoid an overlap between the flight path and that of another unmanned aerial vehicle 300 flying in an adjacent section. Meanwhile, when the aircraft performance of the unmanned aerial vehicle 300 is high or the experience of the pilot is abundant, a flight path is appropriately set even for a congested airspace, and airspaces is more efficiently allocated for the respective unmanned aerial vehicles 300. In addition, even when a flight plan for the unmanned aerial vehicle 300 that is to fly for a hobby purpose is already present, it is possible to preferentially fly the unmanned aerial vehicle 300 that is to fly for a disaster response, for a public service, or for another such purpose of high social value.

Therefore, it is possible to achieve fairness from a broad perspective for a whole society while ensuring the appropriateness of the flight of each individual unmanned aerial vehicle 300 in each airspace. That is, when a plurality of users submit a variety of flight permit applications, it is possible to achieve fair airspace allocation that can satisfy each of the users.

The present invention is not limited to the embodiment described above, and can be modified suitably without departing from the spirit of the present invention.

For example, the airspace level may be three-dimensional information and depend on the height direction from the ground. Specifically, for example, the two-dimensional flyable airspace information is illustrated in FIG. 7, but the flyable airspace information may be three-dimensional information having a component in the height direction. In this case, the determination unit 122 may compare, in an airspace included in the flight path having information in the height direction, the airspace level of the airspace to the magnitude of the authority level, and determine that the airspace is flyable when the authority level is higher.

Further, the description has been given of the case in which the unmanned aerial vehicle 300 autonomously flies under the control of the unmanned aerial vehicle control unit 306 has been described, but the server 100 may control the flight of the unmanned aerial vehicle 300. Specifically, the server 100 is not required to transmit the program for instructing to fly along the approved flight path to the unmanned aerial vehicle 300. The server 100 may issue the instruction through a network at all times so that the unmanned aerial vehicle 300 flies along the approved flight path while repeatedly acquiring the position of the unmanned aerial vehicle 300 in Step S922.

Further, the flight permit application generated by the support device 200 may include information relating to the width of the flight path. Specifically, when the input unit 202 is operated by the user, the support device 200 may acquire information relating to the width of the flight path, for example, 25 m or 50 m, in addition to the departure-and-arrival time information and the departure-and-arrival position information. When the server 100 acquires the flight permit application including the information relating to the width of the flight path, the server 100 may generate a flight path in consideration of the acquired information.

That is, the determination unit 122 may determine whether or not the unmanned aerial vehicle 300 can fly not only in such airspaces overlapping with the flight path having no width as illustrated in FIG. 6 but also in all airspaces overlapping with the flight path having the width included in the flight permit application.

Further, the width of the flight path may be set based on the authority level and the airspace level. Specifically, the flight path generation unit 126 may set the width of the flight path allowed for the unmanned aerial vehicle 300 based on the authority level and the airspace level.

For example, when a difference obtained by subtracting the airspace level from the authority level is larger than a predetermined value, the width of the flight path may be set to be smaller than when the difference is not larger than the predetermined value. Specifically, when the difference obtained by subtracting the airspace level from the authority level is 100, the flight path generation unit 126 may set the width of the flight path to 25 m. Meanwhile, when the difference obtained by subtracting the airspace level from the authority level is 50, the flight path generation unit 126 may set the width of the flight path to 50 m.

Further, the width of the flight path may be set to be smaller as the difference between the authority level and the airspace level becomes larger. Specifically, the flight path generation unit 126 may set, as the width of the flight path, a value obtained by subtracting the difference between the authority level and the airspace level from a predetermined value (for example, 100 m).

In the above-mentioned case, the congestion degree is set based on the number of overlaps with the flight path having the above-mentioned width. That is, when there are a plurality of flight permit applications, a flight path is set for each flight permit application, and a width is set for each flight path. In this case, for each airspace, the number of flight paths overlapping with the airspace differs. Therefore, the congestion degree is set so as to increase as the number of the overlapping flight paths increases.

With this configuration, as the width of the flight path becomes smaller, more unmanned aerial vehicles 300 are more likely to be determined as being flyable. This allows the airspace to be used with efficiency.

Further, for example, the case in which the server 100 and the support device 200 are provided as separate devices has been described, but the server 100 and the support device 200 may be provided as an integrated device.

The invention claimed is:

1. An airspace management system, comprising:

a server, wherein the server comprises:

a microprocessor;

a memory;

wherein the server is configured to:

acquire, for each unmanned aerial vehicle, an authority level of an operation of the unmanned aerial vehicle;

acquire, for each airspace occupying a fixed range, an airspace level indicating an allowable range of the authority level in the airspace;

wherein the authority level and airspace level comprise numeric values;

determine, based on the authority level and the airspace level, whether the unmanned aerial vehicle is flyable in a given airspace;

wherein the airspace level is calculated based on a building density level, a population density level, presence or absence of plant and animal inhabitation, terrain, a congestion degree in terms of the unmanned aerial vehicle, or weather;

wherein the server is further configured to:

acquire a flight permit application including:

departure-and-arrival position information indicating a departure position, which is a position where the unmanned aerial vehicle starts flying, and an arrival position, which is a position where the unmanned aerial vehicle finishes flying; and departure-and-arrival time information indicating a departure time, which is a time when the unmanned aerial vehicle starts flying, and an arrival time, which is a time when the unmanned aerial vehicle finishes flying; and generate a flight path based on the flight permit application, and setting a width of the flight path allowed for the unmanned aerial vehicle based on the authority level and the airspace level, wherein the congestion degree is set, for each airspace, based on a number of overlaps with the flight path having the width; and control the flight of the unmanned aerial vehicle based on the generated flight path.

2. The airspace management system according to claim 1, wherein the authority level is calculated based on a purpose of a flight, a flight mode, a skill of a pilot of the unmanned aerial vehicle, or an aircraft performance of the unmanned aerial vehicle.

3. The airspace management system according to claim 1, wherein the server is further configured to generate flyable airspace information indicating the airspace in which the unmanned aerial vehicle is flyable.

4. The airspace management system according to claim 1, wherein the server is further configured to:

acquire a flight permit application including:

departure-and-arrival position information indicating a departure position, which is a position where the unmanned aerial vehicle starts flying, and an arrival position, which is a position where the unmanned aerial vehicle finishes flying; and departure-and-arrival time information indicating a departure time, which is a time when the unmanned aerial vehicle starts flying, and an arrival time, which is a time when the unmanned aerial vehicle finishes flying; and generate a flight path based on the flight permit application, determine, based on the flight permit application, whether the flight path connecting the departure position and the arrival position over a period from the departure time to the arrival time is allowed to be generated, and generate the flight path when the flight path is allowed to be generated.

5. The airspace management system according to claim 4, wherein the server is further configured to determine again at the departure time whether the flight path is allowed to be generated based on the flight permit application and the flyable airspace information updated at the departure time, when a time at which the flight permit application is acquired is earlier than the departure time by a predetermined amount of time or more, and delete, when it is determined that the flight path is not allowed to be generated at the departure time, the flight path generated when the flight permit application is acquired, and generate an alternative flight path different from the flight path.

6. The airspace management system according to claim 1, wherein the server is further configured to determine that, for each airspace, it is a flyable airspace when the authority level is higher than the airspace level by a predetermined value or more.

7. The airspace management system according to claim 1, wherein the airspace level has a value calculated by performing integration or averaging every unit time during a period from a time when the flight permit application is acquired until the departure time.

8. The airspace management system according to claim 1, wherein the authority level is calculated based on a purpose of a flight, a flight mode, a skill of a pilot of the unmanned aerial vehicle, and an aircraft performance of the unmanned aerial vehicle.

9. The airspace management system according to claim 1, wherein the airspace level is calculated based on a building density level, a population density level, presence or absence of plant and animal inhabitation, terrain, a congestion degree in terms of the unmanned aerial vehicle, and weather.

10. The airspace management system according to claim 1, wherein the authority level is calculated based on the sum of values for a purpose of a flight, a flight mode, a skill of a pilot of the unmanned aerial vehicle, and an aircraft performance of the unmanned aerial vehicle.

11. The airspace management system according to claim 1, wherein the airspace level is calculated based on the sum of values for a building density level, a population density level, presence or absence of plant and animal inhabitation, terrain, a congestion degree in terms of the unmanned aerial vehicle, and weather.

12. An airspace management method, comprising:

acquiring, for each unmanned aerial vehicle, an authority level of an operation of the unmanned aerial vehicle;

acquiring, for each airspace occupying a fixed range, an airspace level indicating an allowable range of the authority level in the airspace;

wherein the authority level and airspace level comprise numeric values;

determining based on the authority level and the airspace level whether the unmanned aerial vehicle is flyable in a given airspace;

wherein the airspace level is calculated based on a building density level, a population density level, presence or absence of plant and animal inhabitation, terrain, a congestion degree in terms of the unmanned aerial vehicle, or weather;

acquiring a flight permit application including:

departure-and-arrival position information indicating a departure position, which is a position where the unmanned aerial vehicle starts flying, and an arrival position, which is a position where the unmanned aerial vehicle finishes flying; and departure-and-arrival time information indicating a departure time, which is a time when the unmanned aerial vehicle starts flying, and an arrival time, which is a time when the unmanned aerial vehicle finishes flying; and generating a flight path based on the flight permit application, and setting a width of the flight path allowed for the unmanned aerial vehicle based on the authority level and the airspace level, wherein the congestion degree is set, for each airspace, based on a number of overlaps with the flight path having the width; and controlling the flight of the unmanned aerial vehicle based on the generated flight path.

13. An airspace management system comprising:

a first computer and a second computer, in communication with each other;

wherein the second computer configured to transmit a flight permit application request to the first computer, wherein the flight permit application request includes departure and arrival position information and departure and arrival time information;

wherein the second computer is further configured to transmit information relating to an authority level to the first computer;

wherein the first computer is configured to receive the flight permit application request and the information relating to an authority level from the second computer;

wherein the first computer is configured to acquire airspace level information, which indicates an allowable range of the authority level in an airspace;

wherein the first computer is configured to calculate an authority level based on the received authority level information;

wherein the authority level and airspace level comprise numeric values;

wherein the first computer is configured to generate a flight path based on the flight permit application request, the authority level and the airspace level information, and set a width of the flight path based on the authority level and the airspace level;

wherein the first computer is configured to transmit the flight path to the second computer;

wherein the airspace level is calculated based on a building density level, a population density level, presence or absence of plant and animal inhabitation, terrain, a congestion degree in terms of an unmanned aerial vehicle, or weather;

wherein the flight permit application includes:

departure-and-arrival position information indicating a departure position, which is a position where the unmanned aerial vehicle starts flying, and an arrival position, which is a position where the unmanned aerial vehicle finishes flying; and departure-and-arrival time information indicating a departure time, which is a time when the unmanned aerial vehicle starts flying, and an arrival time, which is a time when the unmanned aerial vehicle finishes flying; and wherein the congestion degree is set, for each airspace, based on a number of overlaps with the flight path having the width; and wherein the second computer is configured to control the flight of the unmanned aerial vehicle based on the generated flight path.

* * * * *